United States Patent [19]

Verhoeven

[11] Patent Number: 4,469,394

[45] Date of Patent: Sep. 4, 1984

[54] PRESS-FIT ELECTRICAL TERMINALS

[75] Inventor: Laurentius M. Verhoeven, Zijtaart, Netherlands

[73] Assignee: E. I. DuPont de Nemours and Company, Wilmington, Del.

[21] Appl. No.: 471,737

[22] Filed: Mar. 3, 1983

[30] Foreign Application Priority Data

Mar. 4, 1982 [GB] United Kingdom ..... 8206460

[51] Int. Cl.[3] ..... H01R 9/09

[52] U.S. Cl. ..... 339/221 R; 339/252 P; 339/275 B

[58] Field of Search ..... 339/17 R, 17 C, 220 R, 339/221 R, 221 M, 252 P, 276 A, 275 B

[56] References Cited

U.S. PATENT DOCUMENTS

| | | | |
|---|---|---|---|
| 3,546,368 | 12/1970 | Zaleski | 174/94 |
| 3,748,634 | 7/1973 | Barnes et al. | 339/276 A X |
| 3,780,433 | 12/1973 | Lynch | 339/17 C X |
| 3,824,554 | 7/1974 | Shoholm | 339/221 R |
| 3,827,004 | 7/1974 | Heuvel et al. | 339/221 R |
| 4,057,315 | 11/1977 | Miller et al. | 339/221 R |

FOREIGN PATENT DOCUMENTS

| | | |
|---|---|---|
| 2713728 | 5/1978 | Fed. Rep. of Germany . |
| 2365222 | 4/1978 | France . |
| 1591574 | 6/1981 | United Kingdom . |

OTHER PUBLICATIONS

Injectable Solderable Terminal Pins, IBM Tech. Bulletin, vol. 9, No. 4, Sep. 1966, p. 366, H. P. Byrnes.

*Primary Examiner*—Joseph H. McGlynn
*Assistant Examiner*—Steven C. Bishop

[57] ABSTRACT

Press-fit electrical terminals such as press-fit pins for insertion into plated through holes of circuit boards. Such pins have a generally H-shaped press-fit zone formed by a central web 2 indented with a series of transverse corrugations 4 interconnecting four perpendicularly extending compliant fins 10, 11', 12, 12'.

Preferably the terminals are formed by stamping from sheet material with plurality of such pins remaining interconnected to a carrier strip until after mass insertion into plated through holes. Stamping with a pair of corrugated-faced dies into opposed anvil members reduces longitudinal movement of material during swaging and improves dimensional tolerances. The corrugations on the central web reduce flexing of the pin after installation in the plated through hole.

Preferably, the terminals include a slug of solder held on at least a portion of each of the opposed faces of the central web.

12 Claims, 23 Drawing Figures

Fig. 6 (a)
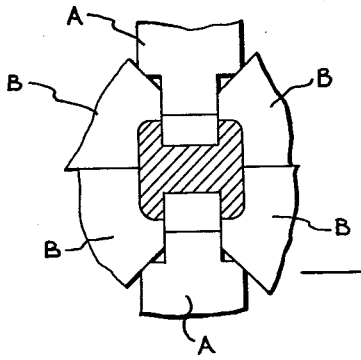
Fig. 6 (b)
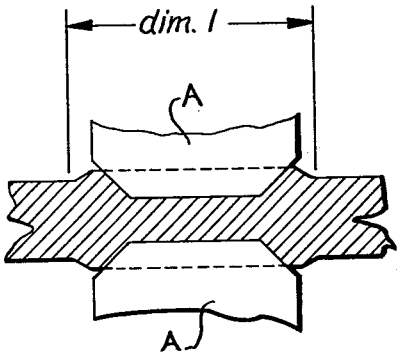
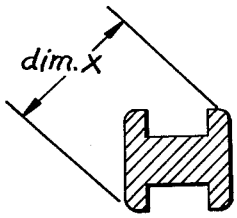
Fig. 6 (c)

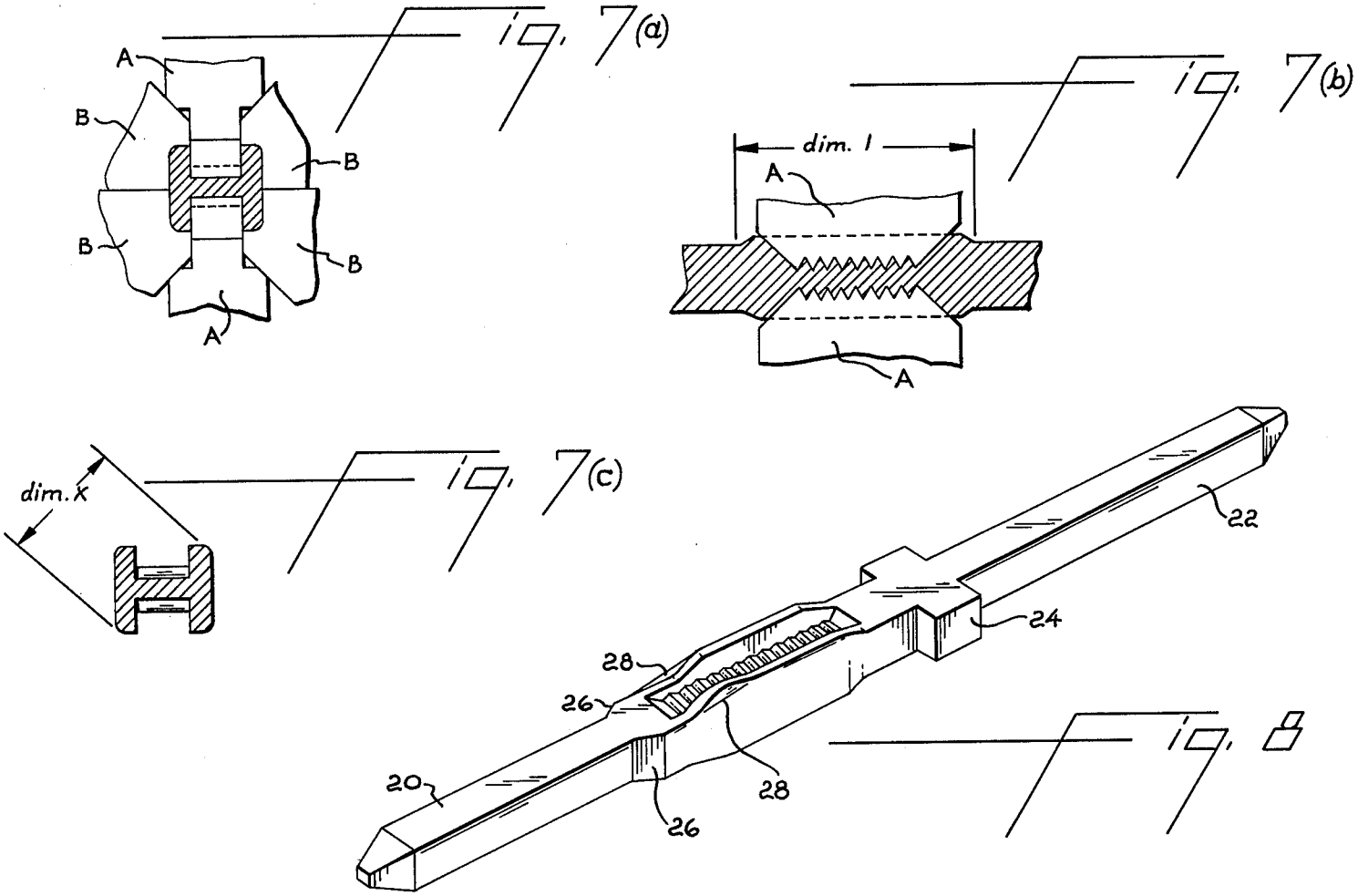
(b)
dim. l
A
A
(a)
A
B
B
B
B
A
(c)
dim. k
22
24
28
26
28
26
20

Fig. 9
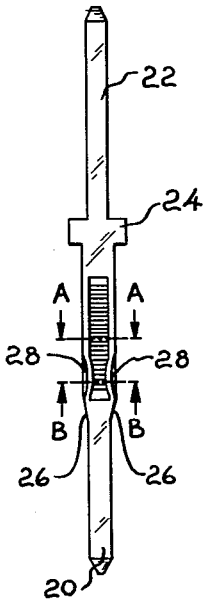
Fig. 10
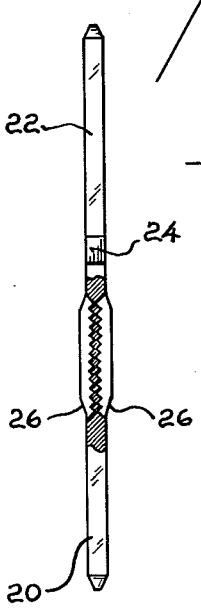
Fig. 11
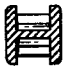
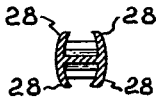
Fig. 12
Fig. 13
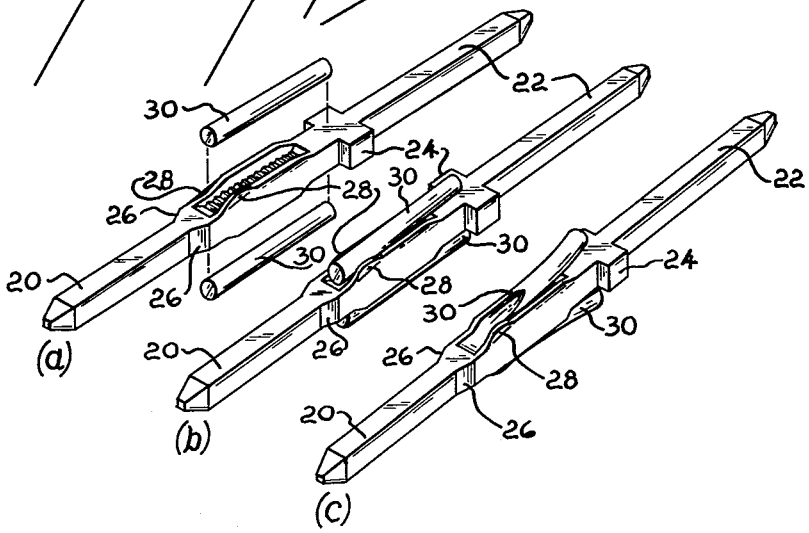

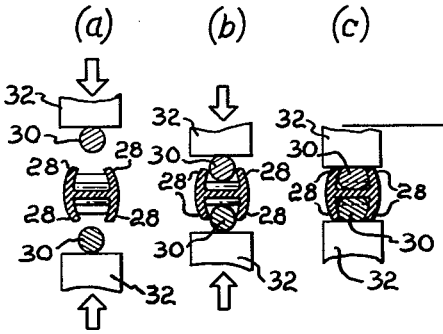
Fig. 14
Fig. 15
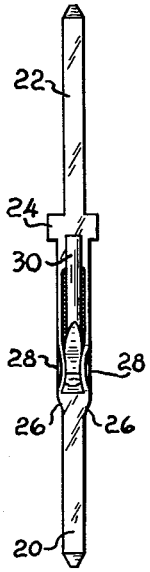
Fig. 16
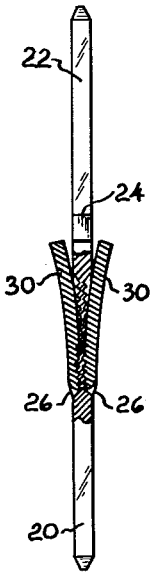
Fig. 17
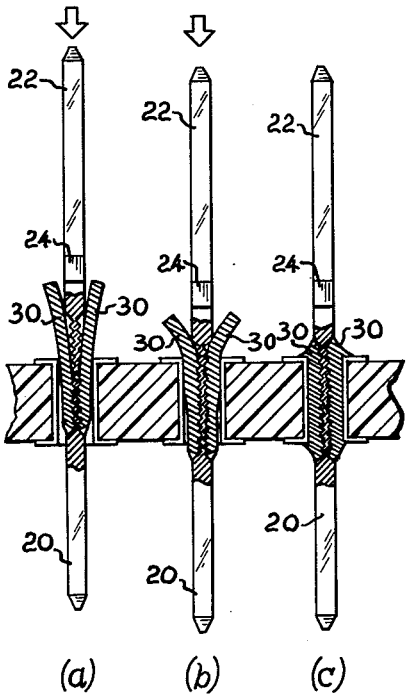

PRESS-FIT ELECTRICAL TERMINALS

BACKGROUND OF THE INVENTION

1. Field of the Invention

This invention relates to press-fit electrical terminals such as press-fit pins for mounting in plated through holes in a printed circuit board. These terminals may be held in recesses in, say, plastic bodies to provide, for instance, edge card connectors. More particularly, the invention relates to such components having a generally H-shaped press-fit zone with compliant fins interconnected by a central web.

2. Description of the Prior Art

A number of designs of press-fit electrical terminals such as pins or connectors are well known in the industry. They have press-fit zones with compliant portions which deform when inserted within a plated through hole of a circuit board or a recess of a plastic housing. The deformed portions locate with the hole or recess and maintain the component rigidly therein.

U.S. Pat. No. 3,827,004 describes a press-fit circuit board pin where the press-fit zone is generally H-shaped. A central web of smooth, planar configuration connects four generally parallel compliant fins to so provide the H-shape. The zone is formed by swaging the pin between appropriate dies. The work hardening involved in forming the fins provides an improved compliancy thereto. The thus formed pins are gathered by an insertion tool and staked into the plated through holes.

Upon insertion within such a plated through hole, the fins deform somewhat in accordance with the shape of the hole.

An H-shaped geometry has the advantage of a relatively rigid central web which prevents excessive flexing of the pin tip after installation. The compliant fins will accommodate insertion into plated through holes of a range of dimensions. This is of advantage since it is difficult to ensure accurate manufacturing tolerances of such holes. Because of this variance in plated through hole dimensions, it is desirable that the manufacturing tolerances of dimensions of the press-fit zone of the pin be maintained as close as possible.

Other forms of press-fit pins are described in, for example, U.S. Pat. Nos. 3,824,554 and 4,057,315. U.S. Pat. No. 3,824,554 describes a press-fit pin having a generally H-shaped press-fit zone, but where the central web joining the fins has symmetrical, inwardly-curved and smooth opposed surfaces. U.S. Pat. No. 4,057,315 describes a press-fit pin in which the press-fit zone includes a plurality of deformed segments alternately spaced from each other in opposite quadrants along the length of the zone.

SUMMARY OF THE INVENTION

The invention relates to an improvement in generally H-shaped press-fit electrical terminals which increases the flexural strength of the component after installation and which enables improved tolerances in the dimensions of the press-fit zone to be achieved during manufacture.

In accordance with one aspect of the invention, there is provided an elongate metal press-fit electrical terminal comprising an electrical terminal portion for electrical interconnection to another electrical component and a press-fit portion for engagement within a recess of an element such as a printed circuit board, said press-fit portion being of generally H-shape in cross-section formed by four compliant fins extending generally parallel to the longitudinal axis of the terminal and interconnected by a central web, the two opposed faces of said web being indented with a plurality of parallel corrugations, the valleys of said corrugations extending transversely to said longitudinal axis.

Preferably the terminal includes a slug of solder held on at least a portion of each opposed face of said central web.

In accordance with a further aspect of the invention, there is provided a method of manufacturing such an elongate metal press-fit electrical terminal, which comprises engaging a zone of an elongate metal member on two opposed sides with anvil members and forming the generally H-shaped section by swaging against said anvil members by striking the metal member between a pair of dies perpendicularly to said two opposed sides, said dies having corrugated faces so as to provide the corresponding plurality of parallel corrugations on the central web of the H-shaped section.

BRIEF DESCRIPTION OF THE DRAWINGS

FIGS. 5(*c*), 6(*c*) and 7(*c*) are cross-sections of the respective products.

FIG. 8 is a perspective view of a second embodiment of a press-fit pin in accordance with the present invention, for mounting in a through hole of a printed circuit board.

FIG. 9 is a plan view of the pin of FIG. 8.

FIG. 10 is a partly sectional side view of the pin of FIG. 8.

FIGS. 11 and 12 are sections along lines A—A and B—B respectively of FIG. 9.

FIGS. 13(*a*), (*b*) and (*c*) are perspective views showing stages during the incorporation of slugs of solder in the pin of FIG. 8.

FIGS. 14(*a*), (*b*) and (*c*) are sections of FIGS. 13(*a*) to (*c*) respectively along lines similar to line B—B of FIG. 9.

FIG. 15 is a plan view of the pin of FIG. 13(*c*).

FIG. 16 is a partly sectional side view of the pin of FIG. 13(*c*).

FIGS. 17(*a*), (*b*) and (*c*) are partly sectional side views showing stages during the insertion of the pin of FIG. 13(*c*) into a through hole of a printed circuit board.

DESCRIPTION OF THE PREFERRED EMBODIMENTS

Figure 1:
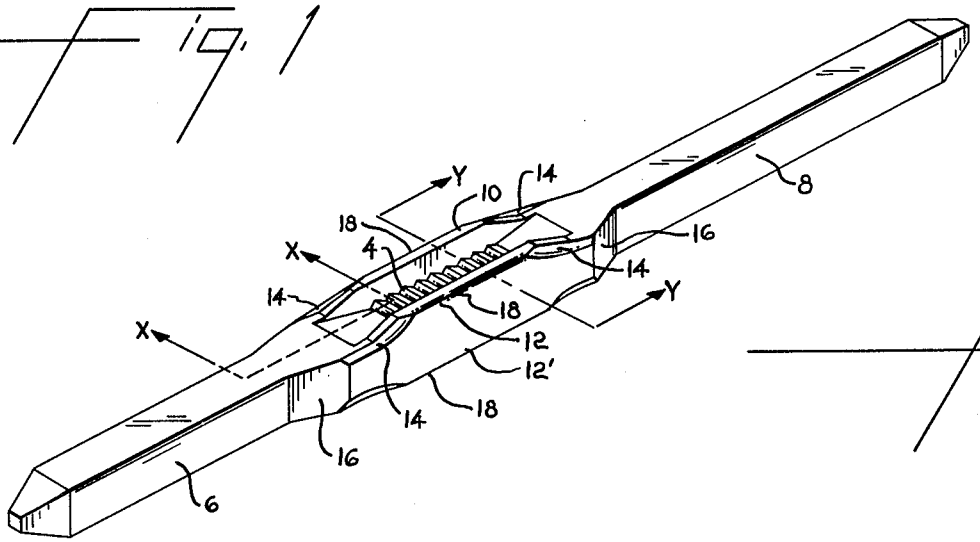
FIG. 1 is a perspective view of a first embodiment of a press-fit pin in accordance with a preferred embodiment of the invention for mounting in a plated through hole of a printed circuit board.
Figure 2:
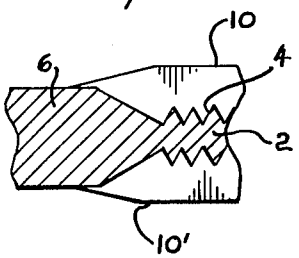
FIGS. 2 and 3 are sections along the lines X—X, Y—Y, respectively, of FIG. 1.
Figure 3:
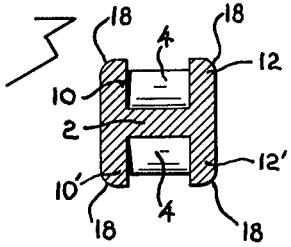

Referring to FIGS. 1, 2 and 3, the press-fit pin comprises a generally H-shaped press-fit zone (best seen in FIG. 3) with the central web 2 being indented with a series of corrugations 4, the valleys of which extend transversely to the longitudinal axis of the pin. The corrugations 4 are located on both opposed faces of the central web 2 of the pin, the web 2 merging to the main body 6, 8 on either side thereof. On each transverse side of web 2 are compliant fins 10, 10', 12, 12' to complete the generally H-shaped section.

The end of each fin is provided with a lead-in area 14 to assist entry of the press-fit zone into the plated through hole. Chamfers 16 at each side of the press-fit zone assist in generally pre-centering the pin in the plated through hole. The outer edge 18 of each fin is curved to assist in providing a greater area of contact with the plated through hole.

When the first pin as described above is pressed into a plated through hole, with the fin dimensions slightly exceeding the hole size, the fins (being compliant) deflect inwardly towards one another. The degree of deflection is dependent on the respective hole undersize. A firm electrical and mechanical contact is achieved to the hole with minimum damage to the hole plating. The corrugations on the central web 2 increase rigidity to improve resistance to flexing of the main body 6, 8 of the pin.

Figure 4:
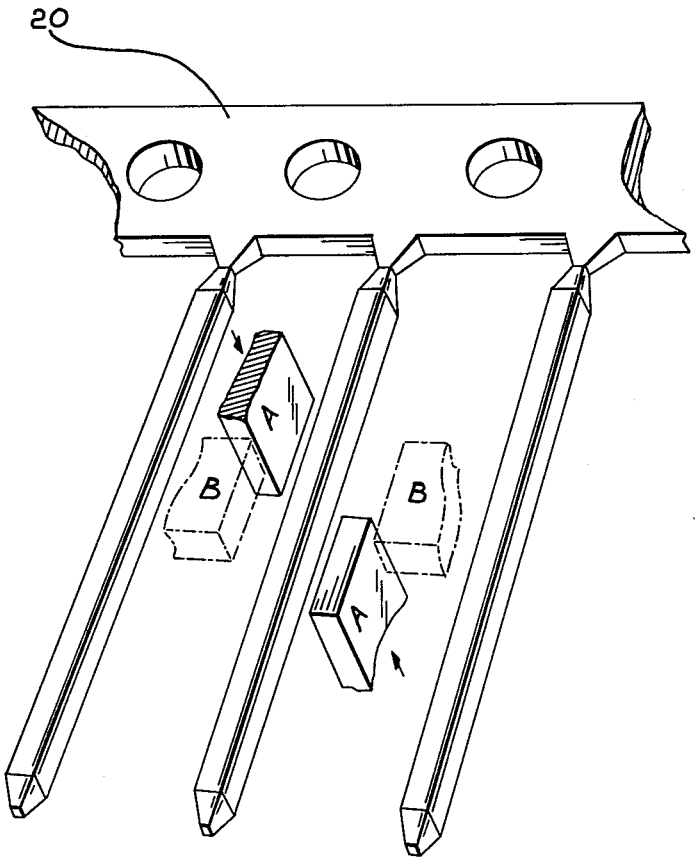
FIG. 4 is a perspective view showing the pin of FIGS. 1 to 3 during manufacture in accordance with a preferred method of the invention.

The pin of FIGS. 1 to 3 may be manufactured from wire by swaging the press-fit zone between appropriate dies, but in a preferred embodiment it is stamped from sheet material. This has the advantage that a plurality of such pins may be formed simultaneously and, by leaving them attached to a carrier strip, enables them to be mass inserted on the circuit board. The carrier strip is then severed after insertion. This is schematically illustrated in FIG. 4, wherein a plurality of such pins is shown being formed while attached to a carrier strip 20. A pair of dies A, A (the detail of which has been omitted) are shown preparing to swage the press-fit zone of one of the pins.

It will be appreciated that the extent of movement for a second pair of dies B,B (shown in phantom and perpendicular to dies A,A) in the plane of the sheet material is severely limited. The extent to which this is solved to provide press-fit zones of improved dimensional tolerances will be described with reference to FIGS. 5 to 7.

Figure 5A:
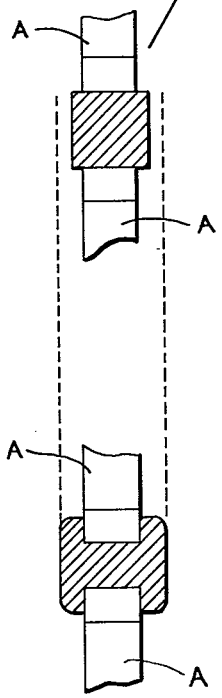
FIGS. 5(*a*) and (*b*), 6(*a*) and (*b*) and 7(*a*) and (*b*) are partial sectional views showing press-fit pins with generally H-shaped press-fit zones during manufacture.
Figure 5B:
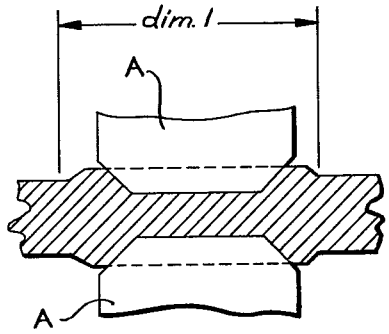
Figure 5C:
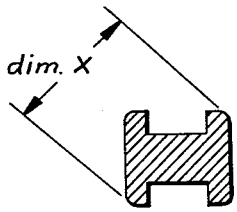

FIGS. 5 to 7 illustrate in more detail the swaging process in forming a generally H-shaped press-fit zone.

Referring to FIGS. 5(*a*), (*b*) and (*c*), the material movement is not restricted during swaging, the dies A, A simply being stamped onto the pin material from either side. As a consequence, large variations in the longitudinal dimension 1 (FIG. 5(*b*)) and cross-section X (FIG. 5(*c*)) are encountered.

An improvement to the FIG. 5 arrangement, which is possible with pins formed from sheet material, is shown in FIG. 6(*a*), (*b*) and (*c*). Four anvil members B are provided to restrict movement of material transversely of the pin during swaging. This provides a closer control on the tolerance of dimension X (FIG. 6(*c*)), but the length growth remains uncontrolled. A relatively large variation in dimension 1 (FIG. 6(*b*)) remains.

A further improvement, and which is preferably employed in the present invention, is illustrated in FIG. 7(*a*), (*b*) and (*c*). The dies A, A are now provided with a series of teeth to form the corresponding corrugations 4 in the central web 2. These opposing teeth reduce material flow in a longitudinal direction and stimulate flow in a transverse direction towards anvil members B. This encourages a more even conformation of pin material to the contours of anvil members B. The arrangement provides a closer tolerance to both 1 and X dimensions.

The first pin described above is useful where the pin is only a desired amount oversize with respect to the plated through hole and where the holes has been properly plated.

However, it is known that it is not always possible to guarantee that the plating on a through hole will be of good quality due to the difficulty in controlling all the steps in the process.

Also the plated through hole is susceptible to mechanical damage due to the following:

(a) Pin insertion, especially where the oversize dimension of the pin is excessive with respect to the hole dimension.

(b) Thermal expansion of the materials. (Generally the plating metal, circuit board, and pin are made of materials having different co-efficients of thermal expansion. Densely packed assembled boards are inherently prone to thermal gradients due to heat generation by the various components of a circuit. Also interfacial junctions are subject to thermal excursions.)

(c) Variations in pin compliancy due to tolerances associated with the pin stamping process.

(d) Material mis-match between the pin and the board, particularly where the same type of pin is used with different types of board.

(e) Mechancial stresses placed on the pin by wire-wrap and in the lateral direction during connection of the pin to the circuit.

By careful selection of the pin and control of the production of the plated through hole it is possible to use the first pin to form a good mechanical and electrical connection. However, where such selection and control cannot be exercised, it may be advantageous to use the pin shown in FIGS. 8 to 12.

Referring now to FIGS. 8 to 12, the second press-fit pin in accordance with the invention also comprises a generally H-shaped press-fit zone (best seen in FIG. 11) with the central web being indented with a series of corrugations, the valleys of which extend transversely to the longitudinal axis of the pin. The corrugations are located on both opposed faces of the central web of the pin, the web merging to the main body 20,22 on either side thereof. On each transverse side of web are complaint fins to complete the generally H-shaped section. The outside edge of each fin is curved to assist in providing a greater area of contact of the pin if it is used in a plated through hole. The construction of the pin thus far is the same as that of the first pin described above.

However, the pin has a shoulder 24 formed in one main body portion 22 for assisting in inserting the pin into a through hole. The shoulder 24 is designed to co-operate with a complementarily shaped applicator tool.

At the end of the press-fit zone remote from the shoulder 24 the pin has chamfers 26 for assisting in generally precentering the pin in a through hole. The ends of the fins adjacent the chamfers 26 have a lead-in area which merges with a curled-in portion 28 of each fin (best seen in FIG. 12). The lead-in area and curled-in portions 28 assist the entry of the press-fit zone into the through hole.

The end of the zone adjacent the shoulder 24 does not have chamfers or curled-in portions.

The second pin may be manufactured by any of the methods described above with reference to the first pin, using appropriately shaped dies and/or anvils.

Two generally cylindrical slugs 30 of solder are attached to the pin as shown in FIGS. 13 to 16, to which reference is now made.

A slug 30 is located adjacent each opposed face of the web and the slugs are forced towards each other using a press or a crimping tool, only opposed parts 32 of which are shown in FIG. 13. The opposed parts 32 have a length approximately equal to the length of lead-in area and curled-in portion 28 of each fin so that each slug is forced into the press-fit zone between each pair of curled-in portions 28 only (as can be seen from FIGS. 13(*a*), 15 and 16).

As the slugs 30 of solder are forced between the fins, they are deformed by hydraulic pressure to fill the space between the fins and to abut tightly in the corrugations of the web, in the area between each pair of curled-in portions 28 (as can be seen in FIGS. 14(*c*) and 15).

In use, the second pin as described above, FIG. 8, is inserted into a through hole in a printed circuit board as shown in FIGS. 17(*a*) to (*c*) to which reference is now made. In these Figures the hole is shown as a plated through hole although this is not necessary with the second pin.

The pin is inserted into the hole using an applicator tool (not shown). The fin dimensions exceed slightly the hole size. The end of the pin remote from the shoulder 24 is inserted and is generally centred by the chamfers 26. As the pin is inserted into the hole, the edges of the hole come into abutment with the lead-in area and curled-in portions 28 of the fins and the pin is thereby centered in the hole.

As the pin is further inserted into the hole the fins (being compliant) deflect inwardly towards one another, thereby gripping the slugs 30 of the solder. The degree of deflection is dependent on respective hole under size.

As the pin is yet further inserted into the hole (as shown in FIG. 17(*b*)) the slugs 30 are pulled along the length of hole and forced into tight abutment with the corrugations along the length of the hole. This is made possible by the locking action on the slugs 30 of the curled-in portions 28 and the corrugations. The slugs 30 are deformed by hydraulic pressure to conform to the shape of the through hole.

If desired the solder slugs 30 may be subjected to a reflow soldering process so that the solder adopts the position shown in FIG. 17(*c*).

The second pin according to the invention has the advantage that, as it is inserted into the hole, the solder slugs are extruded to fit the hole, thereby ensuring an snug mechanical fit of the solder in the hole. Moreover, the hydraulic pressure generated in and transmitted by the solder permits a more uniform deformation of the fins so that the fins more snugly fit into the hole. The pressure also has a tendency to deform the hole periphery, thus limiting hole damage.

As the pin is inserted, the solder tends to scrape a layer of oxide off the circuit board plating especially in the through hole, leaving a bare metal surface which is immediately brought into contact with the solder, thus ensuring good electrical connection and gas tight sealing.

If the solder is subjected to a reflow soldering process, the snugness of mechanical fit is further enhanced and the electrical connection further improved, thereby to improve both the mechanical and electrical properties of the joint.

Once the joint has been completed, inter-atomic migration between the solder and the plating may increase the joint strength and quality, especially where the solder is tin-based and the plating is copper-based.

It will be appreciated that the second pin can be used without a plated through hole as long as a reflow process is used to bring the solder into contact with the plating on the surface of the printed circuit board.

It is not essential for the main body of either of the pins (6, 8 in FIG. 1 or 20,22 in FIG. 8) to be of square cross-section. For example, it could be rectangular or round. Although the corrugations 4 are preferably of a symmetrical saw-tooth section (rising linearly from valleys to peaks and similarly falling), they could also be rounded with curved valleys and peaks.

Although the preferred embodiments have been described in terms of a press-fit male pin for insertion in a plated through hole of a circuit board, the invention applies equally to other terminals requiring a press-fit zone. For example, it applies to terminals having female portions for female connector applications, such as edge card connectors, where the female connector portion is formed as a shaped beam by, for example, swaging on one side of the pin main body, with a male pin portion remaining on the opposite side of the press-fit zone.

I claim:

1. An elongate metal press-fit electrical terminal comprising an electrical terminal portion for electrical interconnection to another electrical component and a press-fit portion for engagement within a recess of an element such as a printed circuit board, said press-fit portion being of generally H-shape in cross-section formed by four complaint fins extending generally parallel to the longitudinal axis of the terminal and inter-connected by a central web, two opposed faces of said web being indented with a plurality of parallel corrugations, the valleys of said corrugations extending transversely to said longitudinal axis.

2. A terminal according to claim 1, wherein a slug of solder is held on at least a portion of each opposed face of said central web.

3. A terminal according to claim 2, wherein each solder slug is held on the terminal by co-operating curled-in portions towards one end of each of the fins.

4. A terminal according to claim 3, wherein the solder slug is pressed into the space between the curled-in portions so that the slug is deformed to fill the space and abut tightly to the corrugations.

5. A terminal according to any one of claims 2 to 4, having a shoulder for co-operation with an applicator tool on the body portion of the terminal remote from the portion of the central web on which the solder slugs are held.

6. A terminal according to claim 2, wherein each fin has a lead-in area, for the terminal for insertion into said recess, at its end adjacent the portion of the central web on which the solder slugs are held.

7. A terminal according to claim 6, wherein the lead-in area merges with the curled-in portion.

8. A terminal according to claim 1, wherein each fin has at one end thereof a lead-in area for the terminal for insertion into a said recess.

9. A terminal according to claim 8, wherein each fin has at its other end a second lead-in area for the terminal for insertion into a said recess.

10. A terminal according to claim 8, wherein the fins extend perpendicularly from the edge of said web, parallel to one another.

11. A terminal according to claim 1, wherein the electrical terminal portion includes a male pin section.

12. A terminal according to claim 11 wherein the male pin section is of square cross-section.

* * * * *